US005540282A

United States Patent [19]

Dallas

[11] Patent Number: 5,540,282

[45] Date of Patent: Jul. 30, 1996

[54] APPARATUS AND METHOD FOR COMPLETING/RECOMPLETING PRODUCTION WELLS

[76] Inventor: L. Murray Dallas, 801 New England Ct., Allen, Tex. 75002

[21] Appl. No.: 328,144

[22] Filed: Oct. 21, 1994

[51] Int. Cl.[6] ..... E21B 19/00

[52] U.S. Cl. ..... 166/379; 166/380; 166/382; 166/387; 166/88.1

[58] Field of Search ..... 166/75.1, 88.1, 166/379, 380, 382, 387

[56] References Cited

U.S. PATENT DOCUMENTS

| | | | |
|---|---|---|---|
| 3,561,531 | 2/1971 | Miller | 166/382 X |
| 3,738,426 | 6/1973 | Drouin | 166/379 X |
| 4,512,410 | 4/1985 | Forester | 166/387 X |
| 4,513,816 | 4/1985 | Hubert | 166/387 X |
| 4,703,807 | 11/1987 | Weston | 166/386 X |
| 5,114,158 | 5/1992 | Le | 166/88 X |
| 5,205,356 | 4/1993 | Bridges et al. | 166/85 |
| 5,394,943 | 3/1995 | Harrington | 166/386 X |

FOREIGN PATENT DOCUMENTS 1302235 6/1992 Canada .

*Primary Examiner*—Roger J. Schoeppel
*Attorney, Agent, or Firm*—Dority & Manning, P.A.

[57] ABSTRACT

An apparatus and method for completing or recompleting wells for production is disclosed. The apparatus and method are particularly adapted to the completion of oil or gas wells having a plurality of production zones. In particular, the apparatus is useful for oil or gas wells having production zones which require stimulation prior to initial production of the well, or producing wells which require recompletion in order to open new zones or to reperforate and stimulate existing zones from which production has slowed down or ceased. The apparatus comprises a header spool having a pressure rating that is about as high as the burst pressure rating of the surface casing of the well. The header spool is mounted to a casing spool before a wellhead is placed on the well. The header spool has an internal passage which is at least as large as the diameter of the casing in the well. This permits an efficient completion of the well after the casing is cemented in. The apparatus in accordance with the invention permits the unobstructed use of a full range of tools including casing perforation tools, blowout preventers, casing plugs, logging tools, fishing tools, and other apparatus required in the completion of a well for production. The method for completing wells involves installing a header spool in accordance with the invention on the well before a wellhead is installed and performing the steps required to perforate the casing and stimulate or fracture the zones requiring treatment in order to prepare the well for production before wellhead equipment is installed. This method and apparatus permits a well to be completed at a significantly less cost than for completing a multi-zone well in the traditional manner of completing after the wellhead equipment is installed.

12 Claims, 3 Drawing Sheets

APPARATUS AND METHOD FOR COMPLETING/RECOMPLETING PRODUCTION WELLS

TECHNICAL FIELD

The present invention relates to wellhead equipment for oil and gas wells and, in particular, to an apparatus and improved method for completing and recompleting oil and gas wells for production.

BACKGROUND OF THE INVENTION

After an oil or gas well bore is drilled, a well casing is generally sunk in the bore and a surface casing is "cemented in" around the well casing. The well is then ready for "completion" to prepare the well for production. In the simplest instance, well completion involves installing wellhead equipment, logging the cased well to locate the production zone(s), and perforating the casing in one or more of the production zones to put the well into hydrocarbon production. Well completion may further involve the high pressure stimulation of production zone(s) in the well to promote better production from the well.

Producing wells are sometimes "recompleted" to stimulate or prolong production. Recompletion of a well involves the perfbration of the well casing in the area of production zones where the casing was not perforated when the well was completed for initial production. Recompletion may also involve the high pressure stimulation of production zones associated with newly perforated and/or originally perforated areas of the casing. Well completion and recompletion are both generally handled by oil and gas well service providers.

The methods for drilling and casing oil and gas wells have evolved considerably in recent years, in particular, the introduction of horizontal drilling tools and techniques, as well as the exploitation of lower yield production zones have placed new demands on oil and gas well service providers responsible for completing wells for production. Traditionally, new wells have been drilled and cased and wellhead equipment has been installed as soon as the surface casing is cemented in. Consequently, any high pressure stimulation procedures required to bring the well into production are conducted using a wellhead isolation tool to protect the wellhead from the excessive pressures, abrasives and/or caustic solutions used to stimulate the flow of hydrocarbons from the production zone(s).

While this method is often effective for stimulating producing wells to increase production, it is not a cost effective way of conditioning certain new wells for production. A problem arises because wellhead isolation tools are stroked through the wellhead equipment and therefore necessarily reduce the diameter of the passage through the wellhead. If a multi-zone well requires high pressure stimulation during completion, it is necessary to initiate a multi-stage process wherein a wellhead isolation tool is stroked through the wellhead for each high pressure stimulation operation and withdrawn between stimulation operations in order to permit perforation tools, isolation plugs and/or blowout preventers, and the like to be inserted into the well. This slows the well completion process and contributes significantly to the cost of preparing a well for production. The cost is particularly significant in deep wells having horizontal bores where tool operations may take a significant amount of time. Service providers such as well fracturing and stimulation contractors charge transportation and setup fees as well as stimulation process fees. Long delays between a requirement for their service is therefore undesirable and expensive, especially if they must take down and move equipment between well stimulation processes for the same well.

To date, the only tool available to accomplish well completion in multi-zone wells requiring stimulation prior to production has been the wellhead isolation tools well known in the art.

SUMMARY OF THE INVENTION

It is an object of the invention to provide an apparatus for the completion or recompletion of oil and gas wells which is safe and efficient to use.

It is a further object of the invention to provide an apparatus for the completion or recompletion of oil and gas wells which permits the use of any tool that can be used in the casing of the well.

It is a further object of the invention to provide a method of completing oil and gas wells for production which permits tool operation and stimulation processes to proceed in an uninterrupted sequence.

It is a further object of the invention to provide a method and apparatus which permits multi-production zone wells to be completed or recompleted considerably more economically than was previously possible.

In accordance with the invention, there is provided an apparatus for completing and recompleting oil and gas wells for production, comprising:

a header spool for sealingly engaging an outer perimeter of a dressed top end of a casing in the well, the header spool having an upper end, a lower end and a passage which extends between the upper end and the lower end, the passage having a diameter which is at least equal to an inner diameter of the casing;

the upper end being adapted to accommodate means for providing a fluid tight attachment of a high pressure valve for controlling a flow of liquids and gases through the axial passage;

the lower end including an annular recess that is coaxial with the axial passage and extends upwardly from the lower end, the annular recess being adapted to accommodate packing for providing a fluid seal between an outer surface of the casing and the header spool when the header spool is installed on the casing in the well;

a retainer means for retaining the packing in the annular recess, the retainer means being adapted to slide over the casing;

the lower end further including a flange adapted for connection to a surface casing spool of the well, the flange being adapted to accommodate means for providing a fluid seal between the header spool and the surface casing spool; and a pressure test port which extends through the lower end of the header spool in an area located between the annular recess and the flange, whereby the pressure test port may be monitored to ensure that pressurized fluids do not pass between the packing and the well casing or the packing and the header spool during a well completion or a well recompletion operation.

In accordance with a further aspect of the invention, there is provided a method of completing oil and gas wells for production, comprising the steps of:

a) mounting a header spool to a surface casing spool of the cased, unheaded well, the header spool having a pressure rating which is at least about equal to the pressure burst strength of a casing in the well, an internal passage communicating with the casing having a diameter at least as large as the internal diameter of the casing, the internal passage being closed at an upper end by a high pressure valve having a gate with a diameter that is at least as large as the diameter of the casing, the header spool including a pressure test port located between a flange for mounting the header spool to the casing spool and the internal passage, and the header spool engaging a top end of the casing in a fluid tight seal adapted to contain pressurized fluids up to pressures about equal to the burst strength of the casing;

b) pressurizing the well to test the seal between the header spool and the casing;

c) inserting a casing perforation tool through the high pressure valve, the header spool and the casing and perforating the casing in the area of a first production zone;

d) extracting the casing perforation tool from the casing, the header spool and the high pressure valve;

e) connecting a stimulation line to the high pressure valve, if stimulation of the first production zone is required, and injecting stimulation fluids or proppants into the first production zone;

f) monitoring the pressure test port to ensure that pressurized stimulation fluids do not escape the seal between the header spool and the casing;

g) inserting an isolation plug into the casing to isolate the first production zone from a balance of the casing;

i) repeating steps b) through f) for each additional production zone of the well;

j) depressurizing the casing to normal well pressure;

k) plugging the casing in an instance when normal well pressure is greater than atmospheric pressure at the top of the well casing; and l) removing the header spool from the surface casing spool and the well casing.

The invention therefore provides an apparatus and a method for completing and/or recompleting oil and gas wells for production. The apparatus consists of a header spool which may be connected to the top end of a casing that is upset and beveled, as normally done for the installation of wellhead equipment. The header spool is preferably constructed to have a pressure rating which is at least about equal to the casing burst pressure. The header spool is designed to provide a fluid tight seal with the casing when it is mounted on a casing spool. The fluid tight seal is provided by chevron packing which is installed in an annular recess in the base of the header spool. The chevron packing is retained in the annular recess by a hollow packing nut that slides over the casing. A pressure test port extends through the lower end of the header spool in an area located between the annular recess and a flange for attaching the header spool to a surface casing spool. The pressure test port is monitored to ensure that pressurized gases and fluids do not escape from the casing by passing between the packing and the casing or the packing and the header spool during a well stimulation operation.

The method in accordance with the invention permits well completion processes to be conducted in an uninterrupted sequence because any tool that can be used in the casing can be introduced through the header spool without restriction. In accordance with the method, the header spool is mounted to an unheaded well requiring completion or recompletion. A high pressure valve, which is preferably a hydraulic valve capable of containing pressures equal to or exceeding the casing burst pressure, is then installed on the header spool. Pressurized fluid is injected into the well to test the seal around the casing. The pressure test port is monitored to ensure that the chevron packing does not leak. Once the seal has been verified, the pressure is permitted to backflow from the well and well completion commences. Well completion in a multi-production zone well usually involves at least the steps of logging a production zone to be completed; perforating the logged zone; stimulating the perforated zone, if necessary; backflowing the stimulation fluids; testing production, if desired; inserting an isolation plug to isolate the prepared zone, if necessary; and, repeating the process until all zones of the well have been prepared for production.

The uninterrupted processing of well completion or recompletion is considerably more efficient and cost effective than prior methods using wellhead equipment and wellhead isolation tools. Previously, it was necessary to set the wellhead isolation tool for each stimulation process and remove the tool for other completion steps because logging tools, casing perforation tools, packers, blowout preventers, and other tools and equipment could not be inserted into the casing through a wellhead isolation tool.

The apparatus and method in accordance with the invention therefore permits the exploitation of wells which were heretofore economically unfeasible to complete for production. The apparatus and method also permit the economical recompletion of producing wells to stimulate or prolong production.

BRIEF DESCRIPTION OF THE DRAWINGS

The invention will now be explained by way of example only and with reference to the drawings, wherein.

DETAILED DESCRIPTION OF THE PREFERRED EMBODIMENTS

Figure 1:
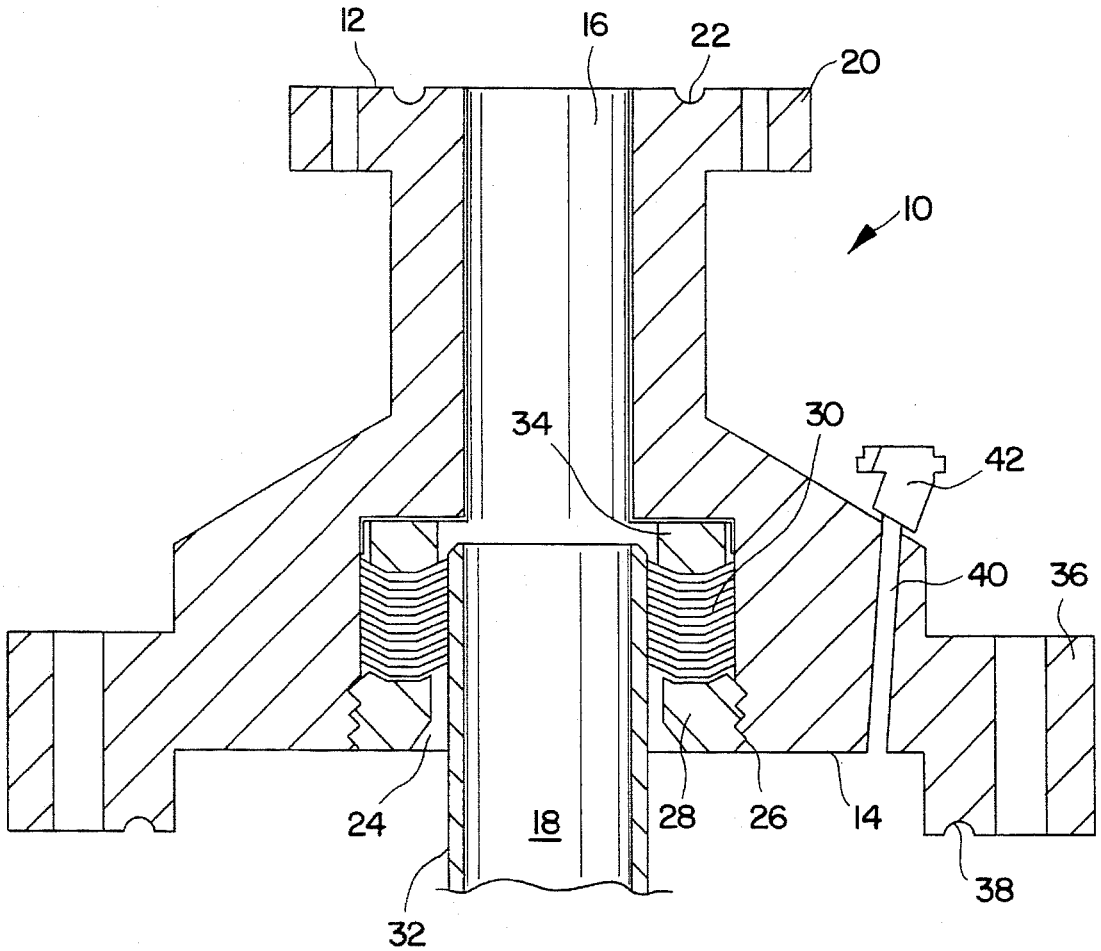
FIG. 1 is a cross-sectional view of a header spool in accordance with the invention mounted to a top of a well casing to permit a well completion or recompletion operation.

FIG. 1 shows a cross-sectional view of a header spool in accordance with the invention, generally indicated by the reference 10. The header spool has an upper end 12, a lower end 14 and a passage 16 which extends between the upper end and the lower end. The passage 16 has a diameter which is at least equal to an inner diameter of a casing 18 to which the header spool 10 is connected. The upper end 12 is provided with a top flange 20 preferably having an annular groove 22 for accommodating a high pressure O-ring (not illustrated). The flange 20 is used to attach a high pressure valve for controlling fluid flow from the casing 18, as will be explained below with reference to FIG. 2.

The lower end 14 of the header spool 10 includes an annular recess 24 that is coaxial with the passage 16 and extends upwardly from the lower end 14. The annular recess 24 preferably includes a spiral thread 26 in its lower end.

The spiral thread retains a hollow retainer nut 28 for supporting a donut-shaped packing 30 for providing a fluid seal between an outer surface 32 of casing 18 and the header spool 10. The packing 30 is preferably a chevron packing, well known in the art. Positioned above the packing is a steel spacer ring 34 for spacing the packing 30 away from a top of the annular recess 24 and ensuring good compression of the packing 30 by the hollow retainer nut 28. As is apparent, the hollow retainer nut 28 is sized to slide over the outer surface 32 of the casing 18 without scoring or abrading the casing.

The lower end 14 of the header spool 10 also includes a bottom flange 36 used to mount the header spool to a surface casing flange as will be explained below. The bottom flange 36 preferably includes an annular groove 38 for accepting a high pressure O-ring (not illustrated) to provide a fluid seal between the header spool 10 and the casing spool to which the header spool is mounted. The header spool further includes a pressure test port 40 which extends through the lower end 14 of the header spool 10 in an area located between the annular recess 24 and the flange 36. Fluid flow through the test port 40 is preferably controlled by a pressure release valve 42, commonly commercially available.

The pressure test port 40 is used to monitor the fluid seal between the header spool 10 and the casing 18 during well completion and recompletion operations, as will be explained below in relation to FIGS. 2 and 3. The header spool 10 is preferably constructed to withstand fluid pressures about equal to the burst pressure rating of the casing 18 so that well stimulation operations can be conducted at the maximum pressure to which the well can be safely subjected, if desired.

Figure 2:
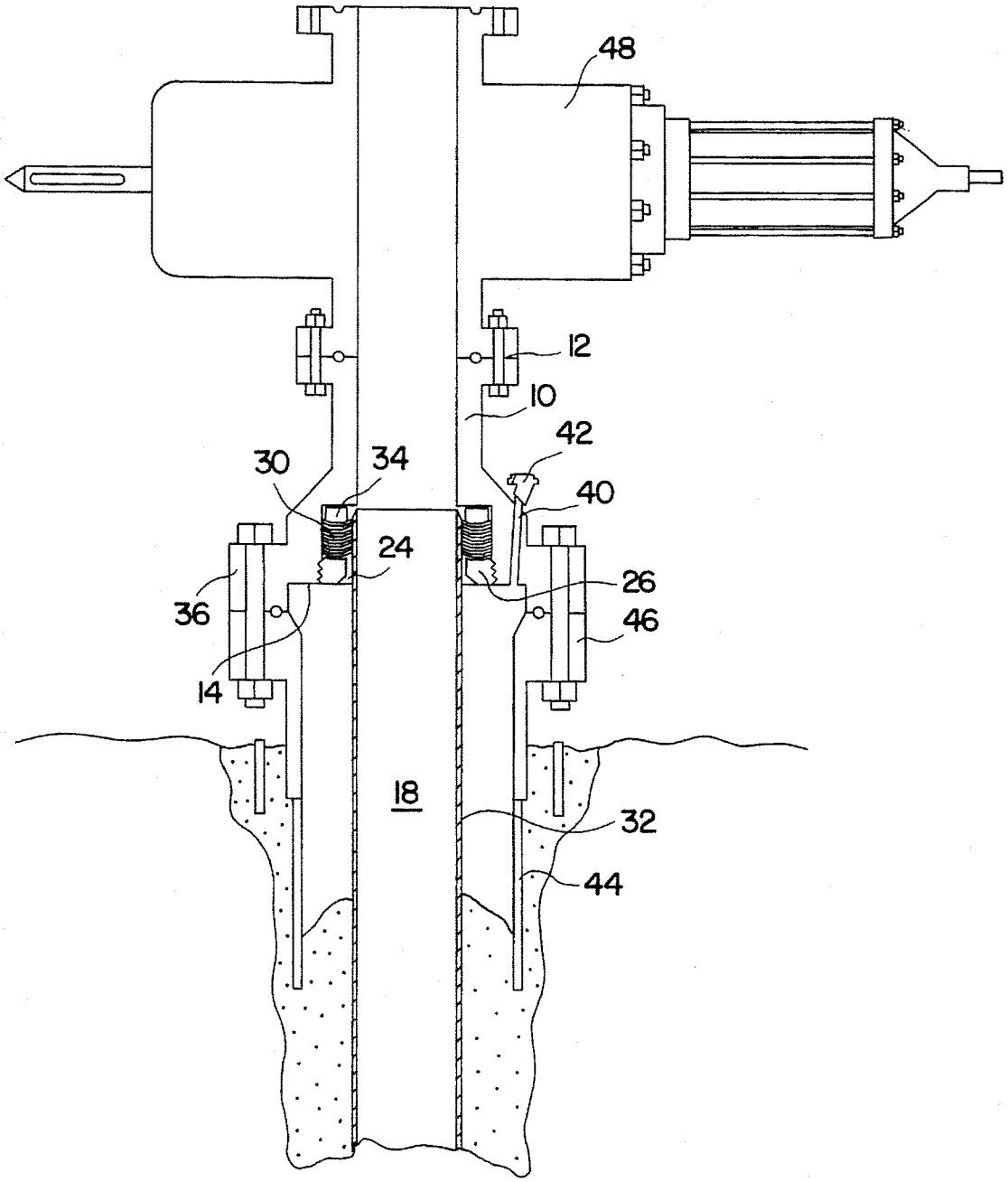
FIG. 2 is a cross-sectional view of the header spool shown in FIG. 1 installed on a surface casing spool of an unheaded well, the header spool having a high pressure valve mounted thereto in preparation for a well completion or recompletion operation.

FIG. 2 shows a header spool 10 in accordance with the invention mounted to an unheaded well casing 18. The well has been drilled, the casing 18 has been sunk in the bore and a surface casing 44 has been "cemented in" in a process well known in the art. The surface casing 44 includes a surface casing spool 46 adapted to support wellhead equipment when the well is completed and ready for production. The header spool 10 is mounted to the casing spool 46 after the well casing 18 has been upset, beveled and cleaned up in a well known manner for preparing a casing for the installation of wellhead equipment. Before the header spool 10 is mounted to the casing spool 46, the spacer ring 34, the chevron packing 30 and the retainer nut 26 are installed in the annular recess 24 in the lower end 14 of the header spool 10. The retainer nut 26 is tightened to securely support the chevron packing 30 in its position. To install the header spool 10, the header spool is carefully lowered over the beveled casing 18 and the chevron packing is forced over the top of the casing to provide a fluid fight seal. Because of the structure of the chevron packing, it is capable of providing a seal that will contain extreme pressures. After the header spool 10 is mounted to the casing 18, it is bolted down to the surface casing spool 46. A high pressure valve 48 is then mounted to the upper end 12 of the header spool 10. The high pressure valve 48 must be capable of containing elevated fluid pressures and preferably has a pressure rating that is about equal to the pressure burst rating of the casing 18. Such valves are normally hydraulically operated and are commercially available. After the high pressure valve 48 is mounted to the header spool 10, the installation is ready for pressure testing and well completion operations as explained below.

Those skilled in the art will perceive that the header spool 10, normally pressure rated for at least 10,000 psi, is bolted to a surface casing spool 46 normally pressure rated for 3–5,000 psi. It must be understood, however, that the surface casing spool is completely isolated from direct fluid pressures because the pressure test port 40 is normally open during pressure testing and well completion or recompletion operations. The surface casing spool is therefore only subjected to a vertical lifting force translated through the header spool 10 from the fluid pressures contained by the high pressure valve 48. Furthermore, since the cross-sectional area of the casing is considerably smaller than the cross-sectional area at the flange of the surface casing spool 46, the vertical lifting force is distributed over a large area and the surface casing spool 46 can readily withstand the vertical strain of holding down the header spool 10.

Figure 3:
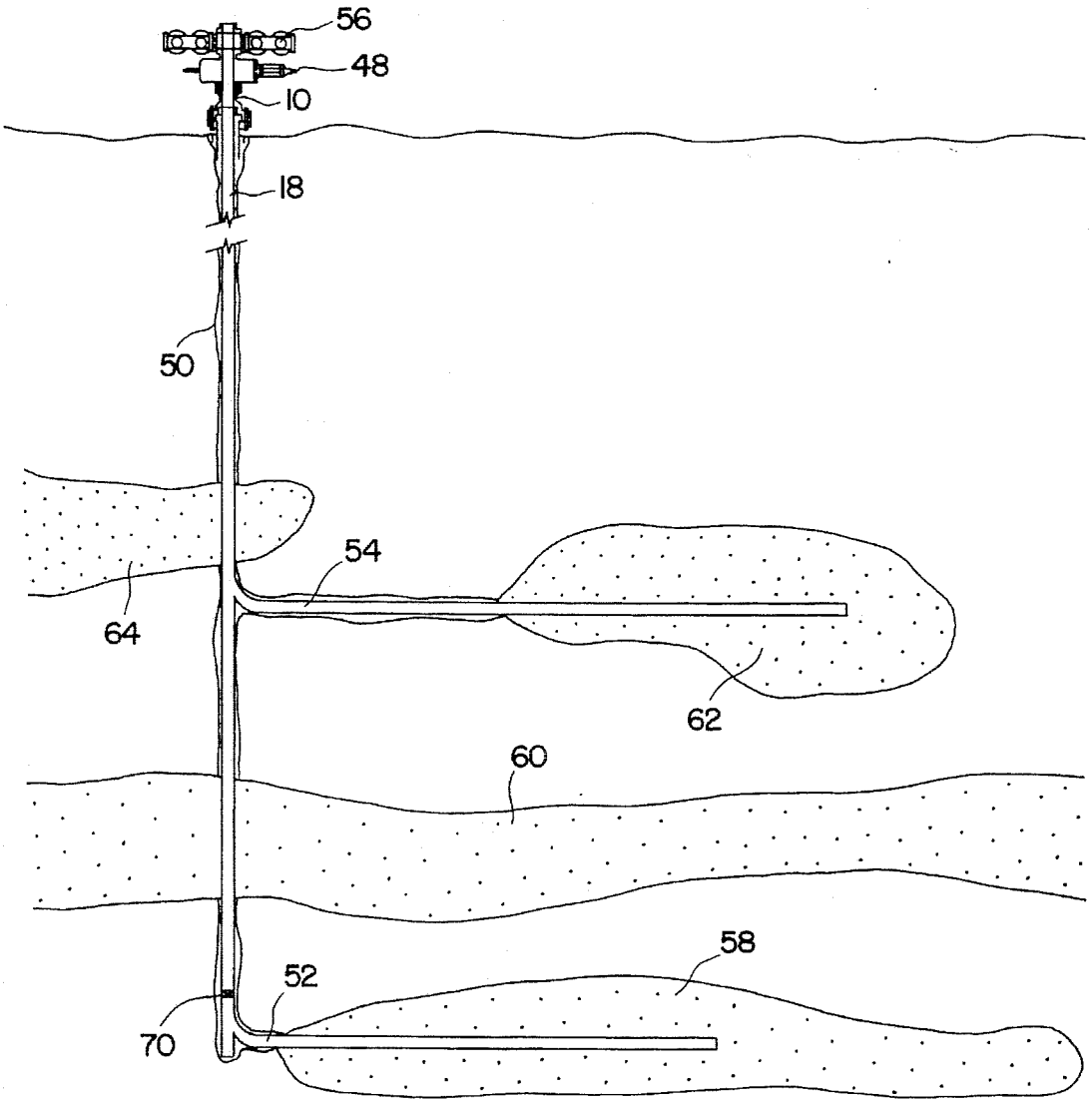
FIG. 3 is a schematic diagram of an apparatus in accordance with the invention mounted to a well that includes horizontal bores, the well being in a condition to be completed for production.

FIG. 3 shows a schematic view of a cased well having a configuration exemplary of a well configuration particularly adapted for completion using the apparatus and methods in accordance with the invention. The well includes a vertical bore 50, a lower horizontal bore 52 and an upper horizontal bore 54. The apparatus in accordance with the invention may be used to complete any well, regardless of the orientation of the bores. Use of the apparatus and method are particularly beneficial when the well has one or more production zones that require high pressure stimulation, and the production zone(s) are too voluminous in combination to be stimulated in a single high pressure acidizing or fracturing process.

As shown in FIG. 3, a header spool 10 has been mounted to the cased, unheaded well. Mounted to the header spool 10 is a high pressure valve 48. Mounted above the high pressure valve 48 is an optional fracturing cross connection 56, commonly referred to as a "frac cross" or a "goats head", and referred to as a frac cross below.

The invention encompasses a method of completing a cased well for production. A typical series of events in the completion of a well for production, such as the well shown in FIG. 3, proceeds as follows:

1) The fluid tight seal at the header spool 10 is tested by connecting a high pressure pump, typically a "frac pump" (high pressure fracturing pump) to the high pressure valve 48 or the frac cross 56. The cased well is pressurized to the maximum pressure desired for the stimulation process to be conducted on the well (typically 6–10,000 psi). The pressure release valve 42 on the pressure test port 40 (see FIG. 2) is opened to ensure that the chevron packing 30 maintains a fluid tight seal around the well casing 18. If no fluid escapes when the pressure release valve 42 is opened, the fluid tight seal is known to be secure. Normally, the pressure release valve 42 is left open during well completion operations so that any leak around the chevron packing 30 is instantly detected.

2) The test fluid pressure is released from the well and a log tool is lowered on a wire line into the well to log the most remote zone in the well bore. For instance, it may be determined that a first production zone 58 requires stimulation to maximize production. After the logging of the zone 58 is completed and the log is analyzed, a casing perforation tool, hereinafter referred to as a "perf gun" (not illustrated) is mounted to a top of the frac cross 56 or the high pressure valve 48 and lowered by wire line into the well to the first production zone 58. The casing is then perforated in that zone or a portion of the zone. The perf gun is then removed from the well. One or two fracturing lines (not illustrated) are connected to the frac cross 56 or the high pressure valve 48. A high pressure stimulation cycle wherein acidic and/or abrasive fluids are pumped under elevated pressures (6–10,000 psi) into the first production zone 58 is performed. After a target stimulation pressure is achieved in the well, the stimulation fluid in the well is permitted to flow back through the header spool 10 and the high pressure valve 48. The well may then be tested to determine the hydrocarbon flow rate from the production zone, or testing may be postponed until the well completion operation is completed. In order to permit the stimulation of a second zone 60, an isolation plug or packer 70 must be positioned between the production zone 58 and the production zone 60. A packer tool is therefore lowered in the well to position the packer or plug 70. Subsequently, the second production zone 60 is logged by lowering a logging tool into the well casing, and the entire sequence of the process is repeated for each of the production zones 60, 62 and 64.

The advantage of this method is that the header spool 10 permits the unobstructed use of any tool which can be used in the casing 18. Well completion procedures can therefore proceed in an uninterrupted sequence. The method therefore provides considerable economy in completing a well for production.

It should also be understood that production tubing, either jointed or continuous tubing, can be run through the header spool 10 into the casing 18. This permits more sophisticated well completion or recompletion operations including reverse circulation in the case of a "screen out" during a stimulation process, manifolded stimulation processes, etc. which can contribute to more efficient and reliable well completion or recompletion procedures.

After the well is completed, stimulation fluids used to stimulate the uppermost production zone treated are permitted to flow back through the header spool 10 and the high pressure valve 48. A packer is then set at the top of the well bore and the header spool 10 is removed from the surface casing spool 46. A wellhead assembly is then mounted to the wellhead, one or more blowout preventers are installed and the well is cleaned before commencing production. Typically, a tubing hanger is installed before the wellhead equipment is installed and production tubing is run into the wellhead before hydrocarbon production is commenced.

While the method of using the header spool in accordance with the invention has been explained in relation to the completion of a cased, unheaded well for production, it will be understood by those skilled in the art that the header spool 10 in accordance with the invention may also be used for recompletion of existing wells having a plurality of production zones which require stimulation and/or which require perforation and stimulation of production zones in unperforated areas of the well casing. In using the header spool 10 for recompletion operations, the procedures described above are typically followed in the same sequence as practiced for completing a newly cased well.

The embodiments of the invention described above are intended to be exemplary only, the scope of the invention being limited solely by the scope of the appended claims.

I claim:

1. Apparatus for completing or recompleting oil and gas wells for production, comprising:

a header spool for sealingly engaging an outer perimeter of a dressed top end of a casing in the well, the header spool having an upper end, a lower end, a pressure rating which is at least about equal to a burst pressure rating of the casing, and a passage which extends between the upper end and the lower end, the passage having a diameter which is at least equal to an inner diameter of the casing;

the upper end being adapted to accommodate means for providing a fluid tight attachment of a high pressure valve for controlling a flow of liquids and gases through the axial passage;

the lower end including an annular recess that is coaxial with the axial passage and extends upwardly from the lower end, the annular recess being adapted to accommodate packing for providing a fluid seal between an outer surface of the casing and the header spool when the header spool is installed on the casing in the well, the packing being adapted to provide a fluid seal having a pressure rating which is at least about equal to a burst pressure rating of the casing;

a retainer means for retaining the packing in the annular recess, the retainer means and the packing being adapted to slide over the casing while the packing is in a fluid sealing position so that the fluid seal is provided when the retainer means and the packing are slid over the casing;

the lower end further including a flange adapted for connection to a surface casing spool of the well, the flange being adapted to accommodate means for providing a fluid seal between the header spool and the surface casing spool; and a pressure test port which extends through the lower end of the header spool in an area located between the annular recess and the flange, whereby the pressure test port may be monitored to ensure that pressurized fluids do not pass between the packing and the well casing or the packing and the header spool during a well completion or a well recompletion operation.

2. Apparatus for completing or recompleting oil and gas wells for production as claimed in claim 1 wherein the packing for providing a fluid seal between an outer surface of the casing and the header spool is a chevron packing.

3. Apparatus for completing or recompleting oil and gas wells for production as claimed in claim 2 wherein the apparatus further includes a spacer ring positioned above the packing for providing a fluid seal between an outer surface of the casing and the header spool, the spacer ring being located at a top of the annular recess.

4. Apparatus for completing or recompleting oil and gas wells for production as claimed in claim 1 wherein the means for retaining the packing in the annular recess comprises a hollow retainer nut which threadedly engages a spiral thread formed in a bottom end of the annular recess, the hollow in the retainer nut accommodating an outside diameter of the casing.

5. Apparatus for completing or recompleting oil and gas wells for production as claimed in claim 1 wherein the apparatus further includes a high pressure valve attached in a fluid tight relationship to the upper end of the header spool.

6. Apparatus for completing or recompleting oil and gas wells for production as claimed in claim 5 wherein the high pressure valve is a hydraulically operated valve.

7. Apparatus for completing or recompleting oil and gas wells for production as claimed in claim 5 wherein the apparatus further includes a high pressure fracturing cross connection attached to a top of the high pressure valve.

8. Apparatus for completing or recompleting oil and gas wells for production, comprising:

a header spool for sealingly engaging an outer perimeter of a dressed top end of a casing in the well, the header spool having an upper end, a lower end and a passage which extends between the upper end and the lower end, the passage having a diameter which is at least equal to an inner diameter of the casing;

the upper end being adapted to accommodate a gasket for providing a fluid tight attachment of a high pressure valve for controlling a flow of liquids and gases through the axial passage;

the lower end including an annular recess that is coaxial with the axial passage and extends upwardly from the lower end, the annular recess being adapted to accommodate a chevron packing for providing a fluid seal between an outer surface of the casing and the header spool when the header spool is installed on the casing in the well, the fluid seal having a pressure rating which is at least about equal to a burst pressure rating of the casing;

a hollow retainer nut for retaining the packing in the annular recess, the retainer nut being adapted to slide over the casing, while the packing is in a fluid sealing position so that the fluid seal is provided when the hollow retainer nut and the packing are slid over the casing;

the lower end further including a flange adapted for connection to a surface casing spool of the well, the flange being adapted to accommodate a gasket for providing a fluid seal between the header spool and the surface casing spool; and a pressure test port which extends through the lower end of the header spool in an area located between the annular recess and the flange, whereby the pressure test port may be monitored to ensure that pressurized fluids do not pass between the packing and the well casing or the packing and the header spool during a well completion or a well recompletion operation.

9. Apparatus for completing or recompleting oil and gas wells through procedures such as well logging, casing perforation and well stimulation operations involving high fluid pressure stimulation of production zones, comprising:

a header spool for operatively engaging a well casing in the well, said header spool having an upper end, a lower end, a passage in fluid communication with the well casing, and a burst pressure rating at least sufficient to withstand well stimulation operations, said passage extending between said upper and said lower end and having a diameter at least equal to an inner diameter of the well casing;

the upper end being adapted for providing a fluid tight attachment of a high pressure valve for controlling a flow of fluids through said passage; and the lower end being adapted for connection to a surface casing and for providing a fluid seal between the well casing and said header spool to substantially maintain fluid flow between said passage and the well casing, the fluid seal being adapted to retain pressures at least sufficient to withstand well stimulation operations, the fluid seal being operative when the header spool operatively engages the well casing.

10. The apparatus as in claim 9, wherein said lower end includes an annular recess coaxial with said passage and extending upwardly from said lower end, said annular recess housing said fluid seal between said passage and the well casing.

11. The apparatus as in claim 9, wherein said header spool includes means for testing for fluid leakage through said fluid seal between said passage and the well casing.

12. The apparatus as in claim 11, wherein said testing means comprises a pressure test port extending through said lower end to a position downstream from said seal between said passage and the well casing.

* * * * *